US005564778A

United States Patent [19]

Shimer et al.

[11] Patent Number: 5,564,778

[45] Date of Patent: Oct. 15, 1996

[54] COMBINATION HIGHCHAIR FOR INFANTS AND INFANT CARRIER

[75] Inventors: Christine R. Shimer, Mahwah, N.J.; Robert N. Shelton, Princeton, Mass.

[73] Assignee: Safe-Strap Company, Inc., Old Tappan, N.J.

[21] Appl. No.: 218,259

[22] Filed: Mar. 25, 1994

[51] Int. Cl.[6] ..... A47D 1/10

[52] U.S. Cl. ..... 297/130; 297/256.16; 292/8

[58] Field of Search ..... 297/256.16, 130, 297/183.2, 183.3, 440.22; 248/137, 139, 141; 292/8, 121

[56] References Cited

U.S. PATENT DOCUMENTS

| | | | |
|---|---|---|---|
| D. 189,664 | 1/1961 | Fulton . | |
| D. 246,553 | 12/1977 | Ballenger . | |
| 344,189 | 2/1994 | Golenz et al. . | |
| 1,330,373 | 2/1920 | Hall . | |
| 1,872,216 | 8/1932 | Appleby | 297/130 X |
| 2,587,881 | 3/1952 | Oakes . | |
| 2,889,152 | 6/1959 | Hurst et al. . | |
| 3,134,627 | 5/1964 | Mason . | |
| 3,649,074 | 3/1972 | McDonald . | |
| 3,669,497 | 6/1972 | Massonnet | 297/440.22 X |
| 3,968,338 | 7/1976 | Reese . | |
| 4,082,349 | 4/1978 | Ballenger . | |
| 4,231,612 | 11/1980 | Meeker . | |
| 4,516,806 | 5/1985 | McDonald et al. . | |
| 4,634,177 | 1/1987 | Meeker | 297/256.16 X |
| 4,743,063 | 5/1988 | Foster, Jr. | 297/130 |
| 4,744,599 | 5/1988 | Jankowski et al. | 297/256.16 |
| 4,750,783 | 6/1988 | Irby et al. | 297/256.16 |
| 4,824,167 | 4/1989 | King | 297/130 X |
| 4,832,354 | 5/1989 | LaFreniere . | |
| 4,915,446 | 4/1990 | Darling et al. | 297/256.16 X |
| 4,984,845 | 1/1991 | Knoedler et al. . | |
| 5,061,012 | 10/1991 | Parker et al. . | |
| 5,172,955 | 12/1992 | Freese et al. . | |
| 5,207,478 | 5/1993 | Freese et al. . | |
| 5,238,292 | 8/1993 | Golenz et al. . | |

FOREIGN PATENT DOCUMENTS

| | | | |
|---|---|---|---|
| 1039393 | 5/1953 | France . | |
| 2227719 | 11/1974 | France | 297/130 |
| 566799 | 9/1957 | Italy . | |
| 321749 | 11/1929 | United Kingdom | 248/139 |
| 2149653 | 6/1985 | United Kingdom . | |
| 9208396 | 5/1992 | WIPO . | |

*Primary Examiner*—Laurie K. Cranmer
*Assistant Examiner*—David E. Allred
*Attorney, Agent, or Firm*—Ostrolenk, Faber, Gerb & Soffen, LLP

[57] ABSTRACT

A highchair for infants has a support structure having four legs, an infant seat disposed on the support structure adapted to cradle an infant's body so as to provide support for the infant's back from below and to conform to the contour of the back of an infant who is to young to sit up without support with the infant's back in an erect position, the support structure having a height which enables the infant to be supported in the infant seat at a height substantially above floor level, and further including a latch detachably coupling the infant seat to the support structure. When the infant seat is detached a convenient infant carrier is thus provided.

17 Claims, 6 Drawing Sheets

COMBINATION HIGHCHAIR FOR INFANTS AND INFANT CARRIER

BACKGROUND OF THE INVENTION

The present invention relates to a highchair for infants, that is, a highchair for young children who do not yet possess the skills to sit up. The highchair according to the present invention is thus directed at newborn infants and generally infants who are under the age of 6 months who do not possess the muscle coordination and ability to sit upright in a conventional highchair. The present invention is thus a highchair for children who are not yet toddlers. Additionally, because the seat of the highchair is detachable from its supporting structure, the invention also relates to an infant carrier.

Various conventional highchairs are known. For example, U.S. Pat. Nos. 3,649,074 and U.S. Pat. Nos. Des. 208,152, 188,844, 192,731 and 237,023 disclose various forms of conventional highchairs. Each of these highchairs has a vertical seat back which cannot be used by infants who cannot sit upright. Each of these highchairs employs a tray in front used during feeding of the child. These conventional highchairs are unable to support an infant who cannot sit upright, as they do not provide the necessary contoured support for such a child.

Various forms of infant and baby seats and carriers are also known, for example, U.S. Pat. Nos. 5,052,749 and 4,231,612. These devices, however, although suitable for use as carriers or car seats for infants, are not suitable for use as highchairs for infants and do not perform the same functions as highchairs.

The present invention is an improvement over the infant highchair described in U.S. patent application Ser. No. 042,543, filed Apr. 5, 1993 in the name of Christine R. Shimer. In the infant highchair shown in that application, an infant seat which cradles an infant's body is disposed at the top of a supporting structure which elevates the infant seat to a level at approximately table height. The supporting structure is mounted on wheels allowing mobility of the infant highchair. That application discloses an infant highchair which has a plurality of positions of the infant seat, i.e., an upright and reclined position, but does not provide for detachment of the infant seat from the supporting structure.

SUMMARY OF THE INVENTION

It is an object of the present invention to provide a highchair which can be used by infants, in contrast to all the known highchairs which are only suitable for use by toddlers.

Thus, it is an object of the invention to provide a highchair suitable for use by infants, i.e., those children below the age at which they possess the skills to sit upright.

It is yet still a further object of the present invention to provide a highchair for infants from newborns until the time that infants can sit upright, typically when they are about six months old.

Furthermore, it is an object of the present invention to provide such a highchair for infants that can be used by infants below approximately 20 lbs. These age and weight limits are only guidelines, since some children might, of course, not develop the necessary skills to use the conventional highchair until later, and the invention can of course be modified to allow its use with infants who do not possess the necessary skills to sit upright even though they may weigh more than 20 lbs.

It is yet still a further object of the present invention to provide a highchair for infants which is easy to use, convenient to move around and which is easy to keep clean.

It is yet still a further object of the present invention to provide an infant highchair which provides for a detachment of the infant seat from the supporting structure of the highchair.

It is yet still another object of the present invention to provide a highchair for infants which allows easy detachment of the infant seat from the supporting structure, and in particular, which allows detachment of the infant seat from the supporting structure by the actuation of the single lever or button using one hand.

It is yet still a further object of the present invention to provide a highchair for infants which is easy to construct, strong and which is safe and stable.

It is yet still a further object of the present invention to provide a highchair for infants which provides a shelf for storage space.

It is yet still a further object of the present invention to provide a highchair for infants, which, once positioned, will not easily be accidentally moved, but which allows simple and secure deliberate movement.

It is yet still a further object of the present invention to provide a highchair for infants which comfortably and safely supports the infant to enable an adult to feed and/or care for the infant at a convenient height, e.g., such as table height.

It is a further object of the present invention to provide a combination highchair for infants and detachable infant carrier.

The above and other objects of the present invention are achieved by a highchair for infants comprising a support structure having a plurality of legs, respective ones of said legs being connected together by connecting top members, an infant seat disposed on the support structure adapted to cradle an infant's body so as to provide support for the infant's back from below and to conform to the contour of the body of an infant who is too young to be able to sit up without support with the infant's back in an erect position, the support structure having a height which enables the infant to be supported in the infant seat at a height substantially above floor level, and means for detachably coupling the infant seat to the support structure.

Other features and advantages of the present invention will become apparent from the following description of the invention which refers to the accompanying drawings.

BRIEF DESCRIPTION OF THE DRAWINGS

The invention will now be described in greater detail in the following detailed description with references to the drawings in which.

DETAILED DESCRIPTION OF THE INVENTION

Figure 1:
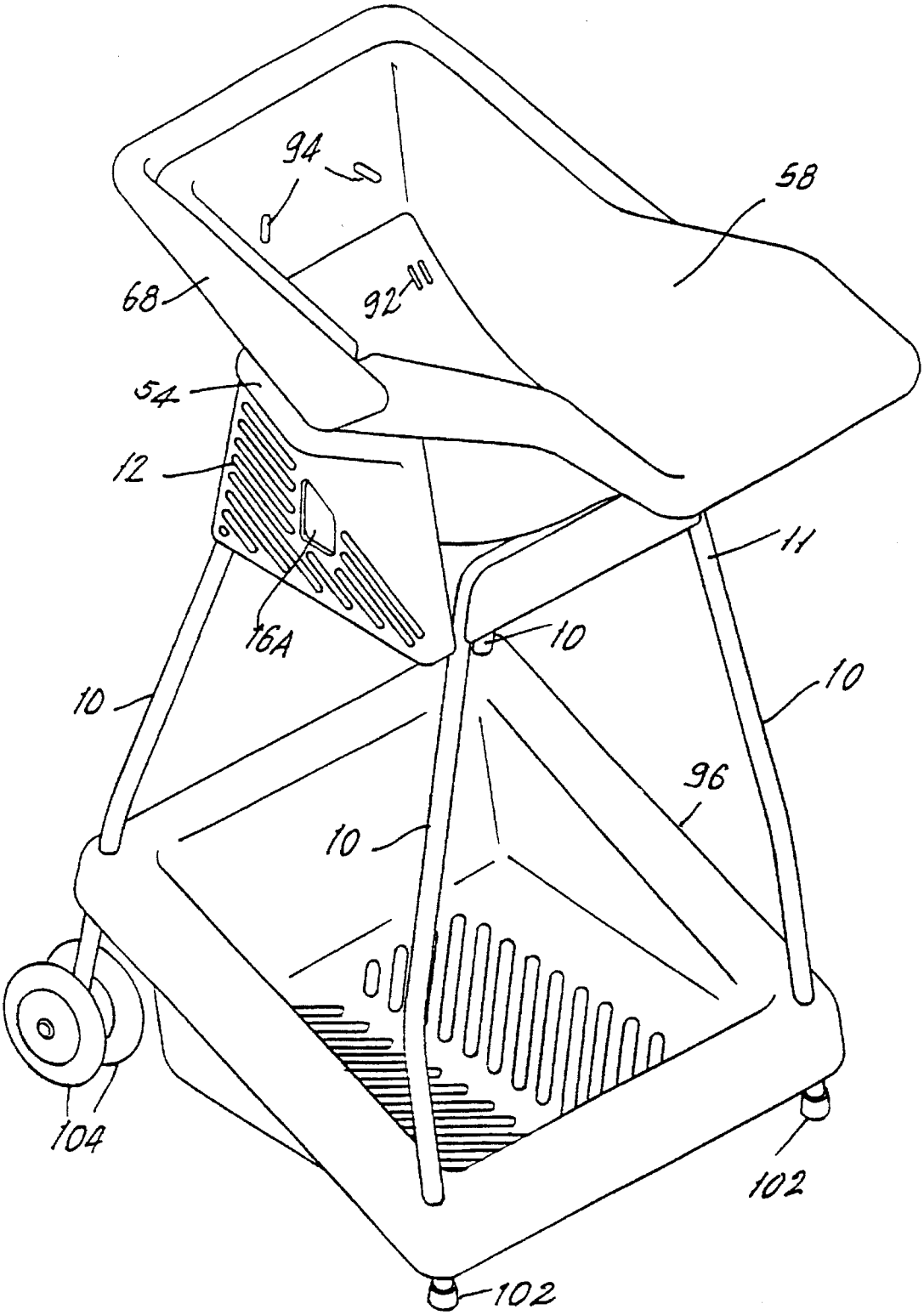
FIG. 1 shows the highchair for infants according to the present invention in perspective view.
Figure 4:
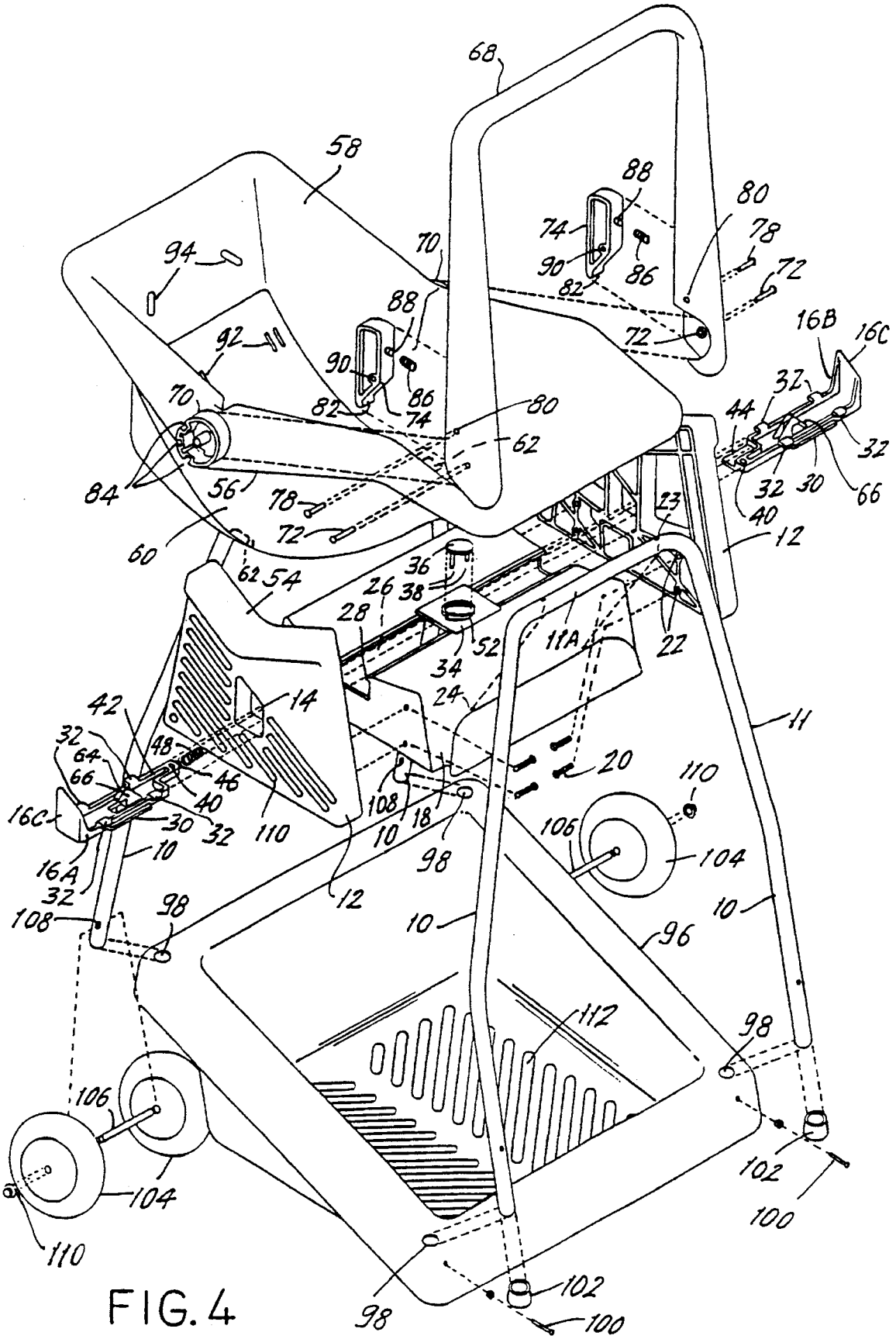
FIG. 4 shows the highchair for infants according to the present invention in an exploded view, showing details of the mechanism for latching the infant seat to the support structure as well as other details relating to the support structure and pivotable carrying handle for the infant seat.

With reference now to the drawings, FIG. 1 shows the infant highchair according to the present invention in perspective view. As shown, the infant highchair preferably includes four legs 10 for stability. Respective pairs of the legs form inverted generally U-shaped support members 11. The U-shaped members can be made from either round or square tubing in cross section. Additionally, the U-shaped members can have flattened apex regions 11A as shown or they can be rounded off at the top. Preferably, the support members 11 comprise metal tubing, such as steel or aluminum tubing. Connecting members 12 are provided connecting each of the support members 11. The connecting members 12 are made of a suitable molded plastic, for example. Each of the connecting members 12 include an aperture 14 molded therein, approximately in the center of the member 12. A latch assembly 16A, 16B is disposed in each of the connecting members 12, as shown more clearly in FIG. 4.

Each of the connecting members 12 is coupled to a central support piece 18, via suitable means such as screws 20. The inner side of each connecting member 12 is provided with suitable screw holes 22 for receiving the threads of the screws 20. Additionally, each of the support members 11 are fastened to the central member 18 with suitable fasteners such as screws. The fastening screws are disposed through holes 23 in the support members 11, the threads of which are received in suitable holes 24 in the central member 18. Central member 18 may also be formed of a suitable molded plastic.

Central member 18 includes a transverse channel 26 disposed therein having top overhanging lip portions 28. Channel 26 receives each of the latch members 16 therein. Each latch member 16 is provided with outwardly extending projections 30 and 32, which form a channel therebetween which receives the lips 28 of the channel 26. At the center of the central support member 18, a plate 34 is provided into which a rotable plug element 36 is disposed. The rotable plug element 36 includes two downwardly projecting rods 38. Rods 38 are received in respective apertures 40 in each of the latch members 16A and 16B.

The two latch members 16A and 16B are not identical in construction. They are complementary. Each latch member has a button actuating surface 16C. Latch member 16A has a projection 42 at one end which overlaps a recessed area 44 in latch member 16B. A further projection 46 is provided on projection 42 which maintains a spring 48 in position. The spring 48 is biased against a vertical surface 50 of latch member 16B. When the latch members 16A and 16B are inserted through the respective holes 14 in the connecting members 12 and extend into the channel 26, with the spring 48 biasing the two latch members 16A and 16B apart, the rotable plug 36 is inserted through an aperture 52 in the plate 34 so that the rods 38 are received in the holes 40 in the two latch members 16A and 16B. The plug 36 thus keeps the two latch members in position against the force of the spring 48 and also performs the function of allowing only one of the latch members 16A and 16B to be actuated to release the infant seat from the support structure, as described below.

Figure 5A:
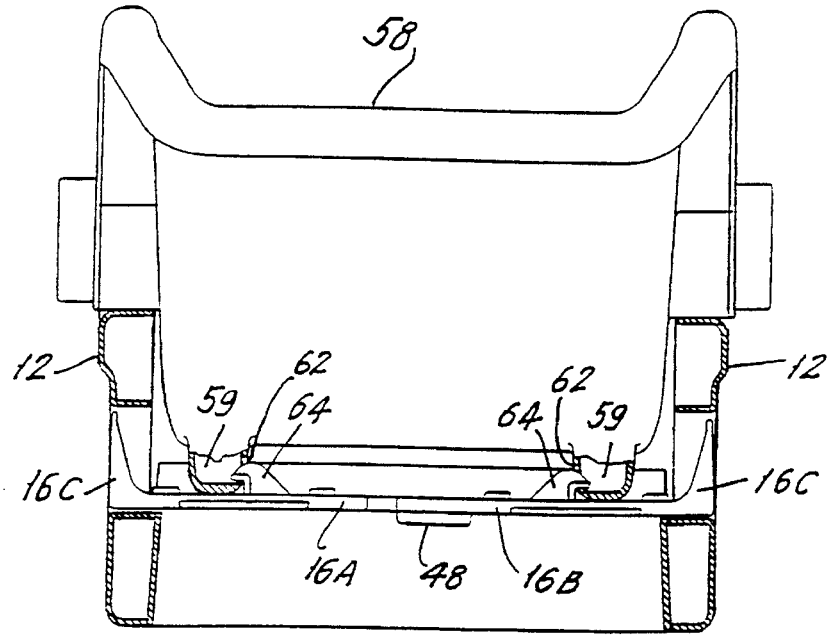
FIG. 5A shows a schematic cross sectional view through the infant seat and latching mechanism in the latched position.
Figure 5B:
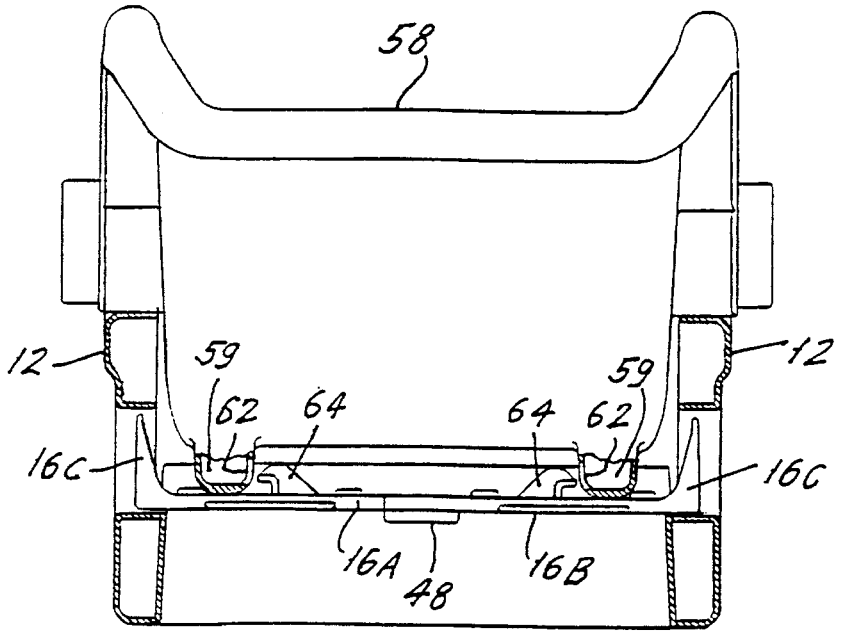
FIG. 5B shows a schematic cross sectional view through the infant seat and latching mechanism in the unlatched position prior to removal of the infant seat from the support structure.
Figure 6:
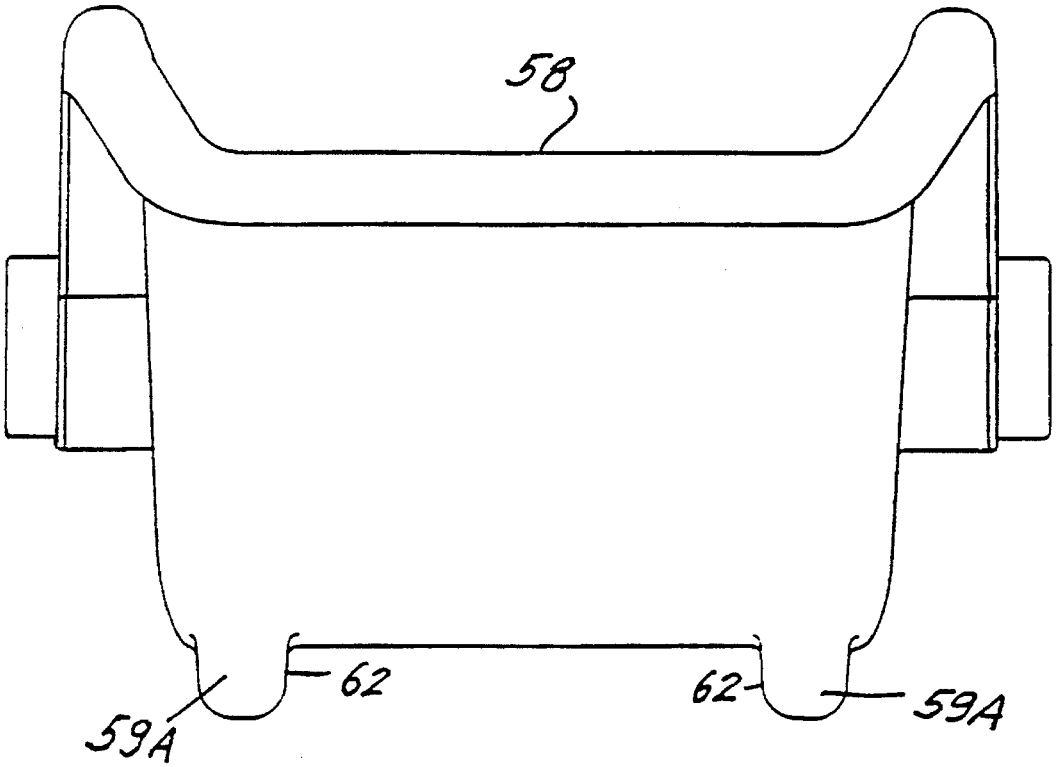
FIG. 6 shows a front cross sectional view through the infant seat showing bottom extending projections in which apertures are provided for receiving the latching members holding the infant seat securely to the support structure.

Connecting members 12 have a V shaped top edge 54, which receives a complementary edge 56 of the molded infant seat 58. Extensions 59 are provided at the bottom of seat 58. See FIG. 6. On each of the bottom extensions 59 of the infant seat 58, an inwardly facing slot 62 is provided. Each slot 62 engages with an outwardly extending hook shaped projection 64 provided on a respective one of each of the latch members 16A and 16B. The hook shaped members 64 are provided with an angled cam surface 66 which engages with the bottom extending portions 59 of the infant seat 58 when the infant seat is being placed on top of the support structure. Due to pressure applied by the user and the weight of the infant seat on the surfaces 66 of the hook shaped projections 64, the two latch members 16A and 16B are forced to move inwardly toward each other against the action of spring 48. After the seat is fully down and the hook shaped projections have cleared the bottom extending portions 59 of the infant seat, the hook shaped projections 64 will snap into the slots 62 due to the action of spring 48. The hook shaped projections 64 thus enter the slots 62 in the infant seat, securing the infant seat to the support structure. FIG. 5A shows the infant seat 58 with the projections 64 disposed in the slots 62, thus securing the infant seat in place. FIG. 5B shows how when one button 16C is depressed, both projections 64 will clear the slots 62, enabling the infant seat to be removed from the supporting structure. The manner in which the actuation of only one button surface 16C releases the seat from the support structure will now be described.

In order to remove the infant seat from the support structure, a user need only depress one of the surfaces 16C of either of the latch members 16A or 16B. Depression of one of the surfaces 16C will cause the plug element 36 to rotate in the aperture 52 in plate 34 due to the misalignment (holes 40 are not disposed along the same line parallel to the channel 26) of the holes 40 in the two latch members 16A and 16B. Rotation due to the force applied to one of the surfaces 16C will cause the other of the latch members also to move inwardly toward the latch member that has been actuated. Thus, both hook shaped projections 64 will move out of the slots 62 in the bottom of the infant carrier, allowing the user then to remove the infant carrier from the support structure with the other hand. See FIG. 5B. Thus, the user can press either button surface 16C to remove the seat from the support structure.

Figure 2:
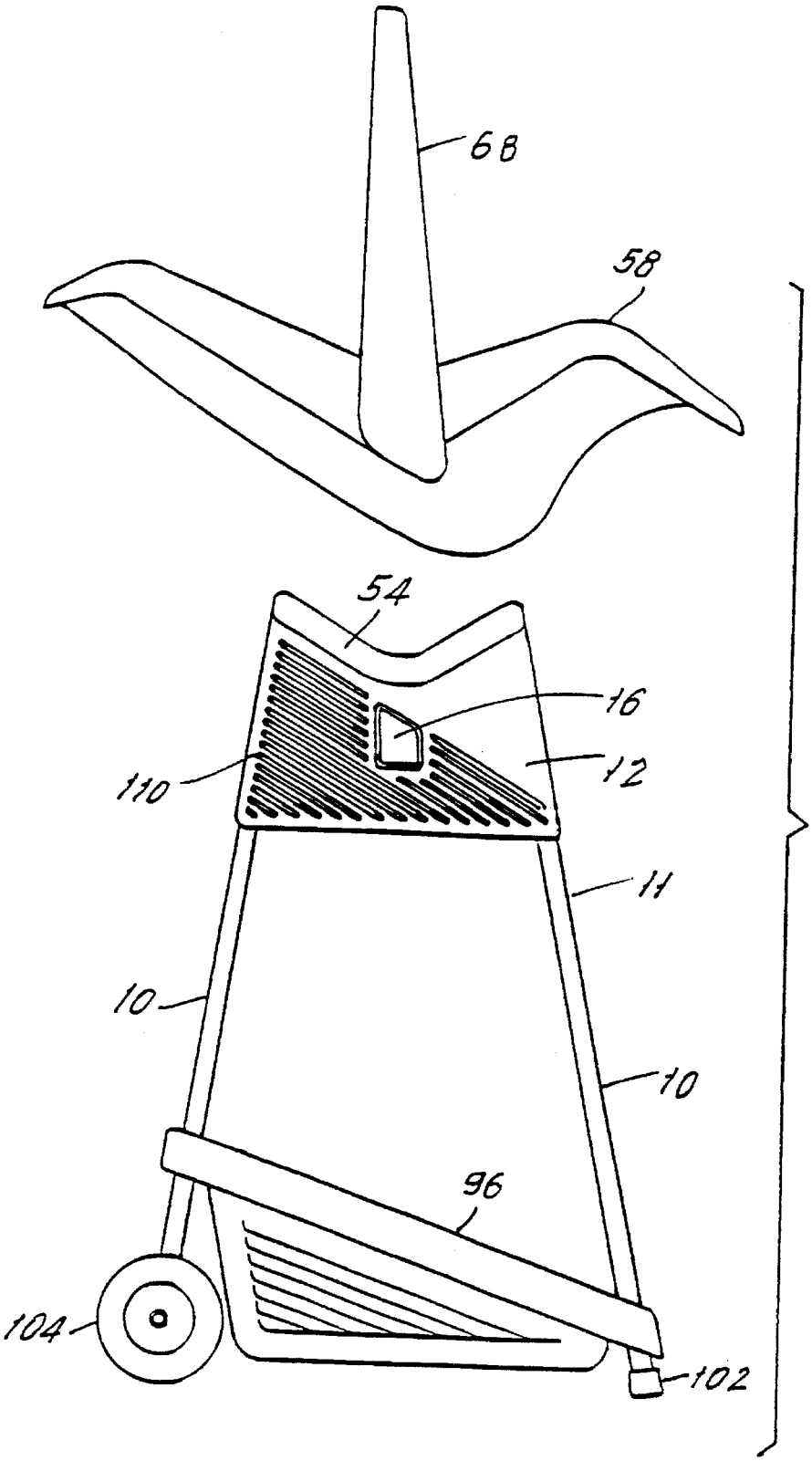
FIG. 2 shows the highchair for infants according to the present invention in a side view, with the infant seat detached from the support structure.
Figure 3:
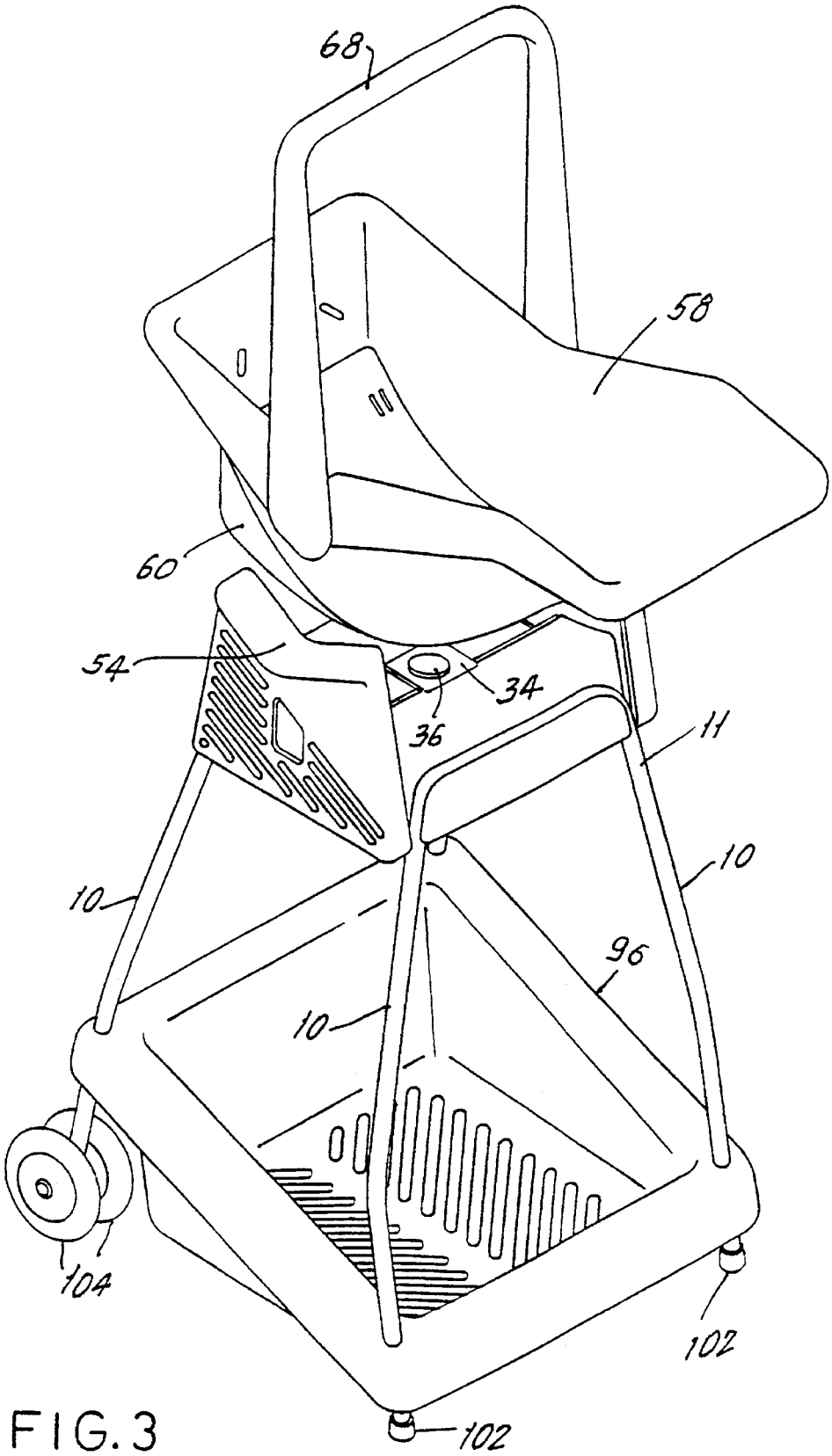
FIG. 3 shows the highchair for infants according to the invention in a perspective view showing the infant seat detached from the support structure.

Preferably, the infant carrier is provided with a suitable handle 68, which is pivotally coupled to the infant seat via a pair of hubs 70. The handle 68 is provided with suitable recesses 72 for receiving the hubs 70. An axle 73 is provided for each hub. The axle 73 for each hub about which the handle 68 rotates may comprise a suitable pin or screw. The handle 68 is provided with a suitable locking means for locking the handle in one of a number of positions. The locking means comprises a lever 74 provided in each handle. Each lever 74 is provided in a recess 76 shown in phantom in FIG. 4. The levers 74 are pivoted about an axle 78 which may comprise a suitable pin or screw disposed in a hole 80. Each lever 74 is provided with a projecting portion 82 which is received in a respective selected one of recesses 84 provided in the hub 70. The recesses 84 provide the handle 68 with a plurality of locked positions of the handle, including an upwardly projecting position shown in FIGS. 2 and 3, an intermediate position as well as the retracted position shown in FIG. 1.

In order to obtain any one of the positions of the handle 68, the user actuates the levers 74, pushing them inwardly farther into recesses 76 against the action of springs 86. Springs 86 are maintained in position on lever 74 by posts 88 molded onto the levers 74. The pressure on the levers 74 causes them to pivot about axle 78 in holes 90 provided in the levers 74, removing the projections 82 from respective ones of holes 84 in each of the hubs 70. The handle 68 can then be pivoted about axle 72 so as to lock the handles 68 in any of the other positions provided by recesses 84 in hubs 70.

Preferably infant seat 58 is provided with suitable slots 92 for receiving seat belts, not shown. Preferably a 3 point seat belt is used employing a crotch belt connecting to a waist belt as known to those of skill in the art and shown, for example, in applicant's above-identified co-pending patent application. Additional holes 94 may also be provided for an optional 10 shoulder strap, as known to those of skill in the art.

When the infant seat 58 is detached from the support structure, a conventional infant carrier is thus provided.

The support structure of the highchair for infants is also provided with a suitable strengthening structure near the bottom portions of the legs 10. Preferably, that strengthening structure comprises a molded shelf member 96 which can serve as a suitable storage space. The strengthening shelf member 96 includes holes 98 at each corner through which the respective leg 10 is received. Preferably, fastening means such as screws and nuts 100 are provided to secure each leg 10 to the structure 96. Preferably, two front legs 10 are provided with plastic or rubber feet 102, and the rear legs are provided with suitable casters or wheels 104 as shown. Each set of wheels 104 is disposed on suitable axle 106 which is secured in a hole 108 in each of the rear legs 10. Suitable fastening clips 110 are provided at each end of each of the axle 106 for maintaining the wheels 104 in position.

Wheel brakes, known to those of skill in the art, can be provided on the wheels 104 in order to lock the highchair for infants in position. Also, wheels can be provided on the front legs if desired. It has been found preferable, however, to provide wheels only on the rear legs and rubber or plastic feet on the front legs. This provides a form of braking action, as once the highchair for infants is located in a position, it cannot be easily moved without lifting the front legs slightly from the floor. Once the front legs are lifted, however, the highchair for infants is easily moved to a new location. Suitable locks can be provided on the rear axles and wheels 104 to prevent lifting of the front of the support structure (rotation of the support structure) more than a specified amount. Thus preventing toppling of the highchair when moved due to an excessive amount of lifting of the front of the highchair.

With respect to the seat 58, it is preferably made of a molded plastic material and the recessed portion thereof receiving the infant is preferably covered with a suitable padding or cloth material to provide comfort. With the exception of the supporting legs 10, and the various fasteners, pivot pins and axles, almost all of the elements of the highchair for infants can be made of suitable molded plastic materials. The molded plastic elements, such as the connecting members 12 and the shelf 96 can have suitable ornamental designs, such as the ribbed designs 110 and 112 shown.

Although the present invention has been described in relation to particular embodiments thereof, many other variations and modifications and other uses will become apparent to those skilled in the art. For example, the movable latch members coupling the infant seat to the support structure are located in the disclosed embodiment on the support structure. They could easily be disposed on the infant seat instead. Further, a different number of legs and different arrangements of wheels can be used than disclosed herein, all still within the scope of the invention. Therefore, the present invention should be limited not by the specific disclosure herein, but only by the appended claims.

What is claimed is:

1. A highchair for infants comprising:

a support structure having a plurality of legs;

an infant seat disposed on the support structure adapted to cradle an infant's body so as to provide support for the infant's back from below and to conform to the contour of the back of an infant who is too young to be able to sit up without support with the infant's back in an erect position, the support structure having a height which enables the infant to be supported in the infant seat at a height substantially above floor level; and means for detachably coupling said infant seat to the support structure;

said means for detachably coupling includes a latch member coupled to said support structure having means for detachably fastening to a bottom portion of said infant seat, the latch member includes a hook shaped projection received in a slot disposed at the bottom of said infant seat, said latch member further includes first and second latch members slidably received in a central member of said support structure, each of said latch members having a hooked shape projection received in a respective slot disposed at the bottom of said infant seat, said two latch members being received in a channel for linear slidable movement in said support structure wherein said latch members move linearly into and out of said slots, and retained in position against a force biasing said latch members away from each other, said latch members being disposed in said channel such that, if a first of said latch members is moved in said channel, from its slot the second of said latch members moves in an opposite direction thereby removing the hook shaped projection of each of the latch members from a respective slot in the infant seat, allowing the infant seat to be removed from the support structure.

2. The highchair for infants recited in claim 1, wherein the latch members are biased by a spring providing a force causing each of said latch members to move away from each other and means for maintaining each of said latch members in position against the force of said spring, said means for maintaining comprising a pivoting member whereby when a first of said latch members is moved inwardly toward the second of said latch members, said pivoting member rotates, causing said second latch member to move toward the first latch member, thereby removing said hook shaped projections from said slots in the bottom of said infant seat.

3. The highchair for infants recited in claim 1, wherein said infant seat includes a handle thereon for holding said infant seat when said infant seat is detached from said support structure and for grasping said infant seat when removing said infant seat from said support structure or depositing said infant seat on said support structure.

4. The highchair for infants recited in claim 3, wherein said handle is pivotably coupled to said infant seat.

5. The highchair for infants recited in claim 4, wherein said handle is a generally U shaped element having a respective hub at each end of said handle coupling said handle to said infant seat.

6. The highchair for infants recited in claim 5, wherein said hub includes a plurality of detent positions for allowing said handle to be disposed in a plurality of selected positions.

7. The highchair for infants recited in claim 1, wherein the legs have lower ends adjacent a floor surface on which they are adapted to be adjacent, and further comprising a wheel disposed at selected ones of the lower ends of said legs.

8. The highchair for infants recited in claim 1, wherein the legs have lower ends adjacent a floor surface on which they are adapted to be adjacent, and further wherein said support structure has two rear legs and two front legs and wherein a wheel is disposed at the lower end of said rear legs.

9. The highchair for infants recited in claim 8, wherein said front legs are provided at the lower ends thereof with frictional elements for resisting movement.

10. The highchair for infants recited in claim 9, wherein said frictional elements comprise rubber or plastic feet.

11. The highchair for infants recited in claim 1, wherein said support structure comprises four legs.

12. The highchair for infants recited in claim 11, wherein two front legs are coupled together to form a first inverted generally U-shaped member and two rear legs are coupled together to form a second inverted generally U-shaped member.

13. The highchair for infants recited in claim 12, wherein the two inverted generally U-shaped members are coupled together by said central member.

14. The highchair for infants recited in claim 13, wherein the central member is coupled to two side pieces each having a generally V-shaped surface, and the infant seat has a complementary V-shaped facing surface for engagement with said V-shaped surface.

15. The highchair for infants recited in claim 13, wherein said infant seat, central member, side pieces and latch members each comprise a plastic material.

16. The highchair for infants recited in claim 1, wherein said support structure comprises four legs.

17. The highchair for infants recited in claim 1, wherein the infant seat, when detached from the support structure, comprises an infant carrier.

* * * * *